United States Patent [19]

Itoh

[11] Patent Number: 4,671,216

[45] Date of Patent: Jun. 9, 1987

[54] AIR INTAKE DEVICE FOR A V-TYPE ENGINE

[75] Inventor: Toshifumi Itoh, Saitama, Japan

[73] Assignee: Honda Giken Kogyo Kabushiki Kaisha, Tokyo, Japan

[21] Appl. No.: 803,045

[22] Filed: Nov. 29, 1985

[30] Foreign Application Priority Data

Nov. 30, 1984 [JP] Japan ..... 59-253362

[51] Int. Cl.[4] ..... F02M 35/04

[52] U.S. Cl. ..... 123/52 MV; 123/195 C; 123/195 AC; 123/198 E

[58] Field of Search ..... 123/198 E, 52 MV, 195 A, 123/195 C, 195 AC

[56] References Cited

U.S. PATENT DOCUMENTS 3,026,861 3/1962 Brown ..... 123/52 MV
3,171,393 3/1965 Planter et al. ..... 123/52 MV

FOREIGN PATENT DOCUMENTS 13263 1/1982 Japan ..... 123/198 E
183510 11/1982 Japan ..... 123/198 E
167871 10/1983 Japan ..... 123/52 MV

OTHER PUBLICATIONS

Cycle World, "Harley-Davidson XR1000-Cycle World Test", Mar. 1983, pp. 46-53.
Cycle World, "Cycle World Test: Yamaha XV1000 Virago", Oct. 1984, pp. 30-34.

*Primary Examiner*—Ira S. Lazarus
*Attorney, Agent, or Firm*—Lyon & Lyon

[57] ABSTRACT

An air inlet means for use with the two cylinder internal combustion V-type engine. The air inlet device includes a carburetor, an air cleaner and an air associated with each cylinder. Such carburetors and inlet pipes are arranged so as to be positioned between the engine cylinders with the air cleaners extending outwardly from between the cylinders so as not to interfere with the fuel tank.

6 Claims, 10 Drawing Figures

AIR INTAKE DEVICE FOR A V-TYPE ENGINE

BACKGROUND OF THE INVENTION

Traditionally, two-cylinder V-type internal combustion engines for motorcycles have been arranged such that the angle between the cylinders of such engines was 90 degrees. The benefits of such a configuration and arrangement are widely known to those skilled in the art. For example, so configured it is possible to arrange the engine in the motorcycle, along with the attendant intake components, so as to accomplish gravity feeding of fuel from the fuel tank to the engine carburetors without interference with the fuel tank and its capacity. It is well recognized that gravity feeding is desirable in such engines, especially when such engines are mounted on a motorcycle.

Recently, it has been recognized that it is sometimes desirable to develop an engine system which is more compact or provides a different configuration. For example, two cylinder, V-type engines are possible with the cylinders separated by an angle of 70 degrees rather than the traditional 90 degrees. Upon mounting such an engine on the motorcycle frame, however, it was necessary to provide auxiliary fuel tanks below the level of the carburetors and a fuel pump to the engine to replace the space taken up by the traditional air intake systems of such engines. The reduced angle between the cylinder blocks left little room for intake components. Consequently, the components had to be moved upwardly into interference with the fuel tank on a motorcycle.

SUMMARY OF THE PRESENT INVENTION

The present invention provides an air intake device for a V-type internal combustion engine wherein the angle between the cylinders is less than 90 degrees. The intake system of the present invention for a two-cylinder engine includes two air cleaning means mounted outwardly of the engine. The air cleaning means are attached to carburetors mounted in the space between the engine cylinders and beneath the fuel tank, thereby enabling the engine of the present device to utilize the benefits of gravity flow from the fuel tank.

Consequently, it is an object of the present invention to provide an improved intake system for a V-type engine and the engine therefor. Other and more detailed objects of the present invention will become apparent upon examination of the materials contained herein.

DESCRIPTION OF THE PREFERRED EMBODIMENTS

Figure 1:
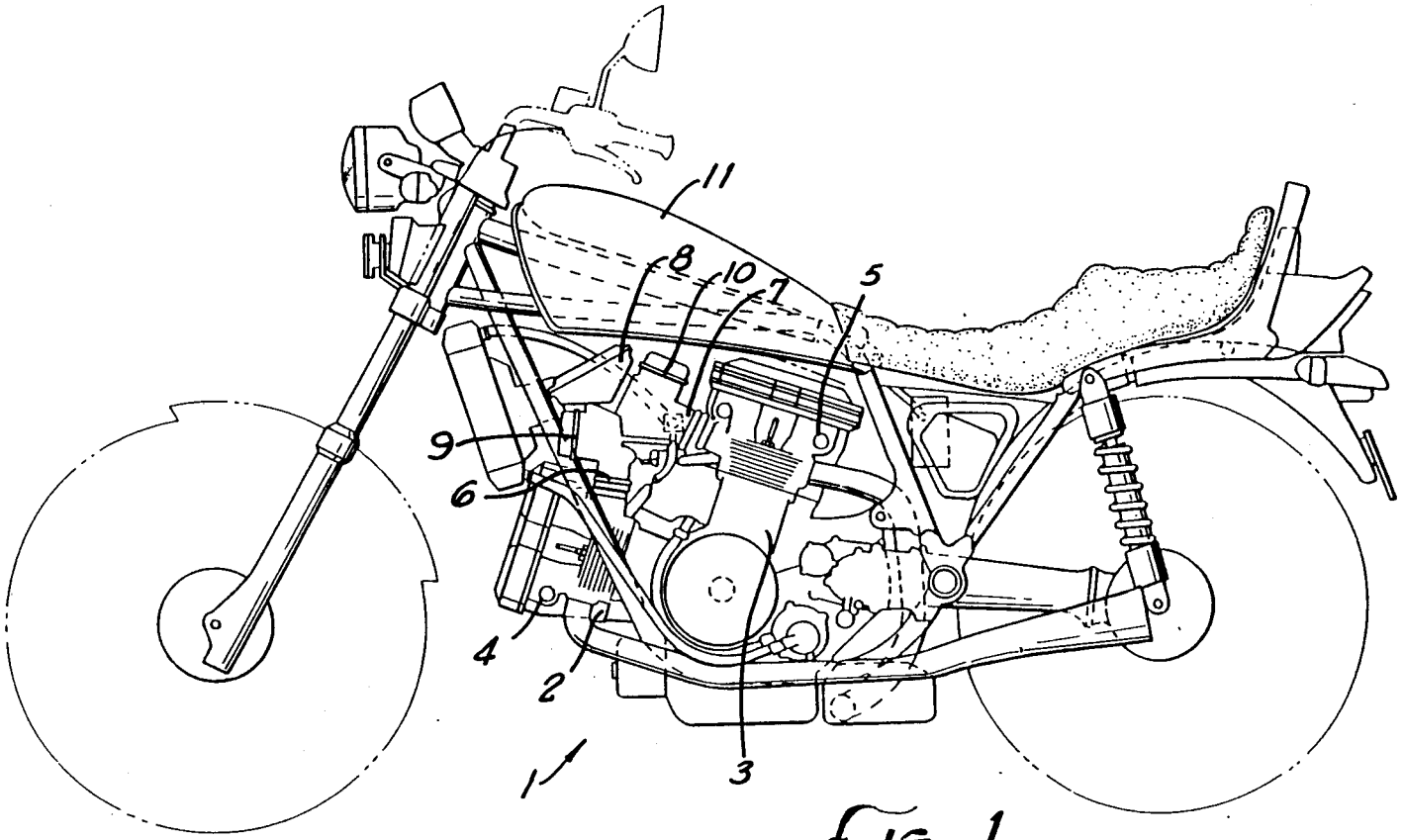
FIG. 1. PRIOR ART
FIG. 1 is a side view of a motorcycle incorporating the devices of the prior art.

As illustrated in FIG. 1, a typical two-cylinder engine 10 has a first cylinder 11 and a second cylinder 12 arranged at substantially 90 degrees apart. A pair of cylinder heads 4 and 5 are positioned on each cylinder 2 and 3, respectively, of the engine 1. An air intake 6 and 7 enters into each cylinder head 4 and 5, respectively, for operation of the engine 1. An air cleaner 8 is positioned within the air intake passages 6 and 7 in order to filter the air entering into the engine 1. A carburetor 9 and 10 is positioned near the air intake passage 6 and 7 of each cylinder head 4 and 5 in order to provide fuel from the fuel tank 11 to the cylinders 2 and 3, respectively. In such a configuration, where the carburetors 9 and 10 are positioned beneath the fuel tank 11, it is possible to feed fuel from the fuel tank to the carburetors through gravity feed means, thereby avoiding the use of a fuel pump or the like.

As shown in FIGS. 2–6, 9 and 10, where the engine cylinders are arranged at an angle of less than 90 degrees, it is necessary to reconfigure the air intake system in order to retain the advantages of a gravity fed fuel system. For purposes of example, the present invention is shown on an engine 16 configured such that the cylinders 17*a* and *b* are at an angle of 70 degrees.

The motorcycle 12 has a body frame 13 and a main frame 14. A fuel tank 15 is positioned above the area in which the engine 16 is positioned. The engine 16 has two cylinders 17*a* and *b* each having a cylinder head 18*a* and *b* positioned thereon, respectively. Each cylinder head 18*a* and *b* has an intake passage 19*a* and *b* and an exhaust passage 20*a* and *b*, respectively. An intake pipe 21*a* and *b* communicates the intake passages 19*a* and *b* of the cylinder heads 18*a* and b with its associated carburetor 22*a* and *b*, respectively. The intake pipes 21*a* and 21*b* include elbow sections which extend from the cylinder heads in opposite directions.

Figure 2:
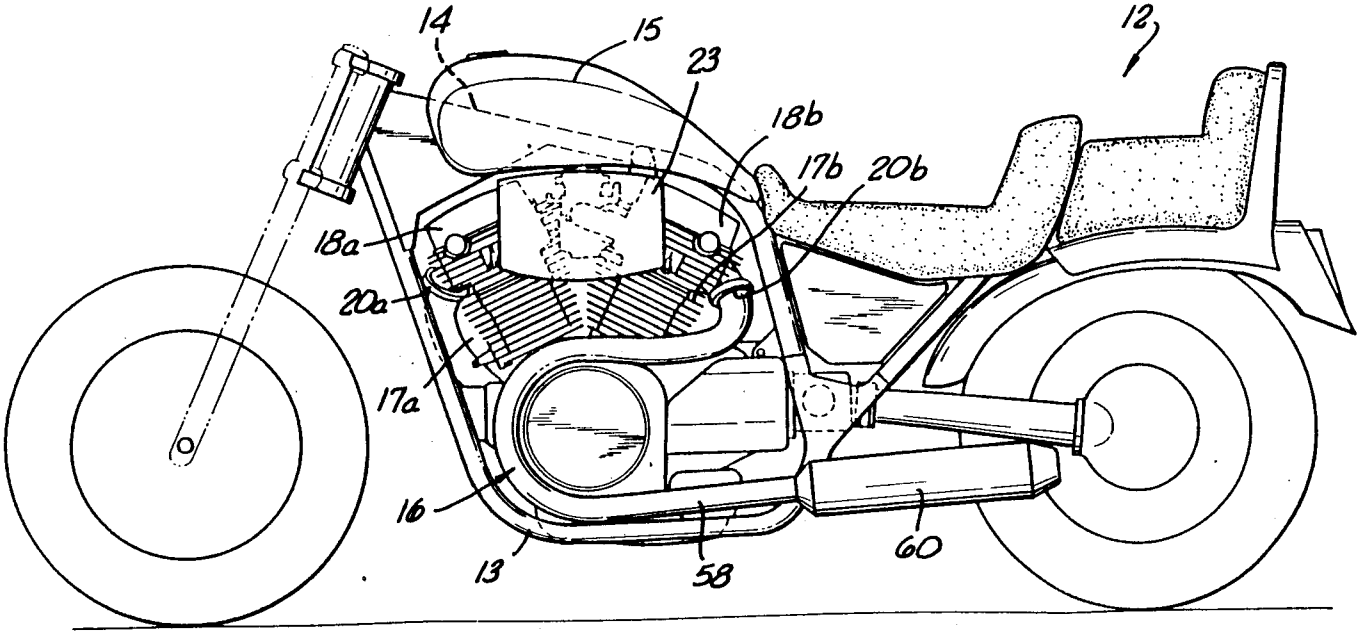
FIG. 2 is a side view of a 70 degree two-cylinder engine including the present invention which is mounted on a motorcycle.
Figure 3:
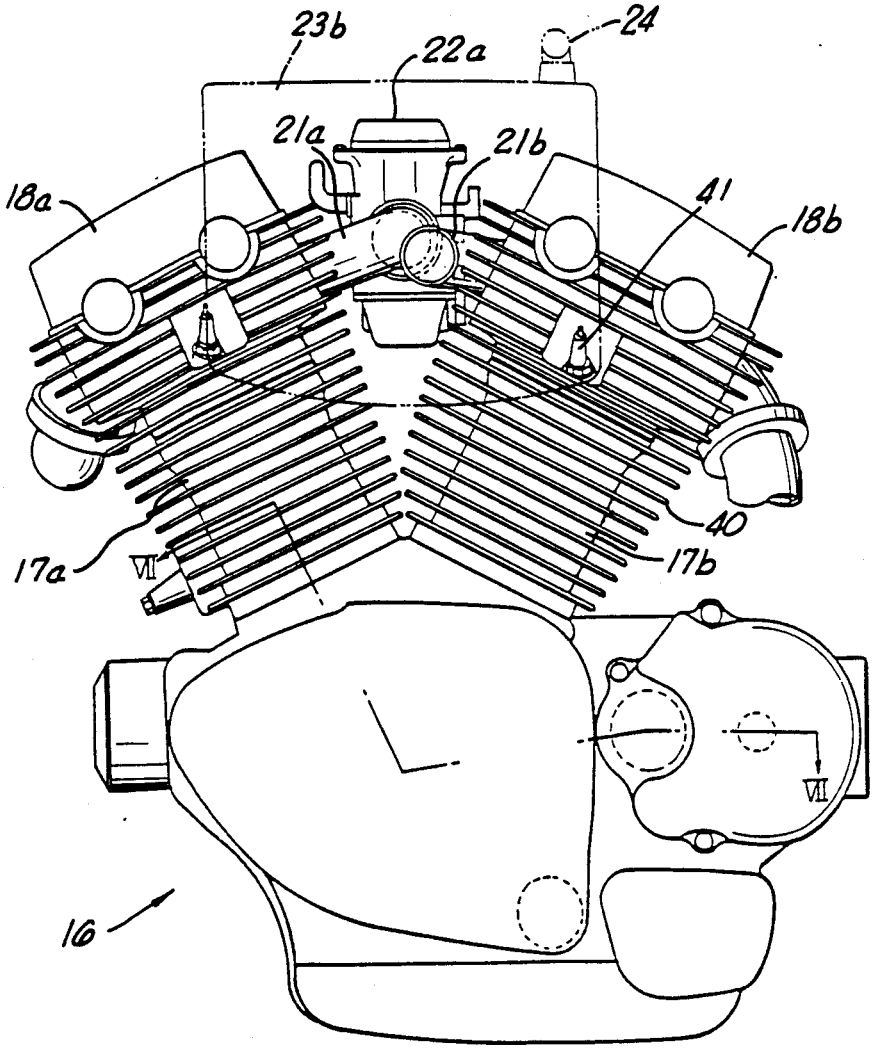
FIG. 3 is a partial cross sectional side view of an engine including the present invention.
Figure 4:
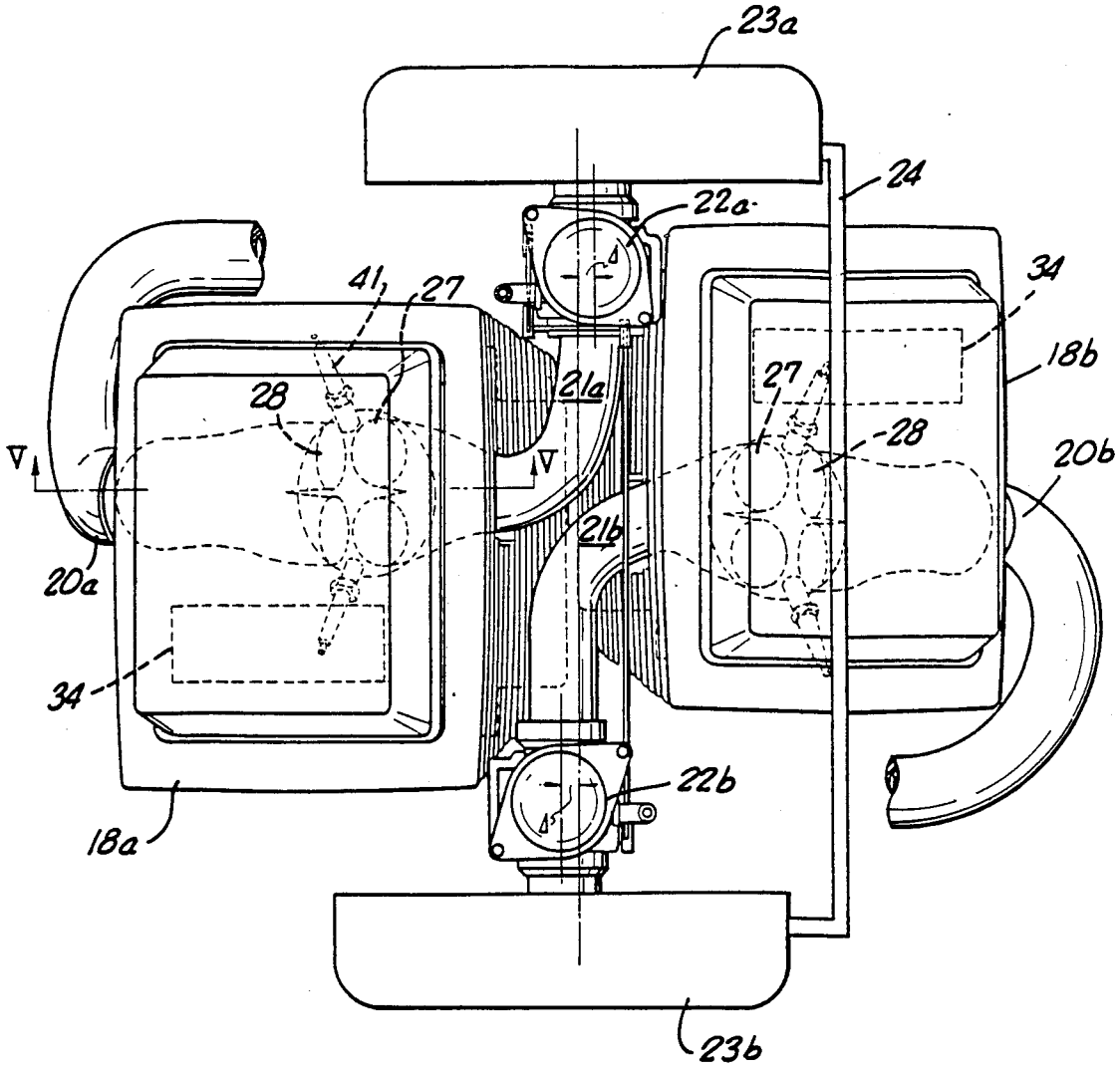
FIG. 4 is a top view of a 70 degree two-cylinder engine including the present invention.
Figure 5:
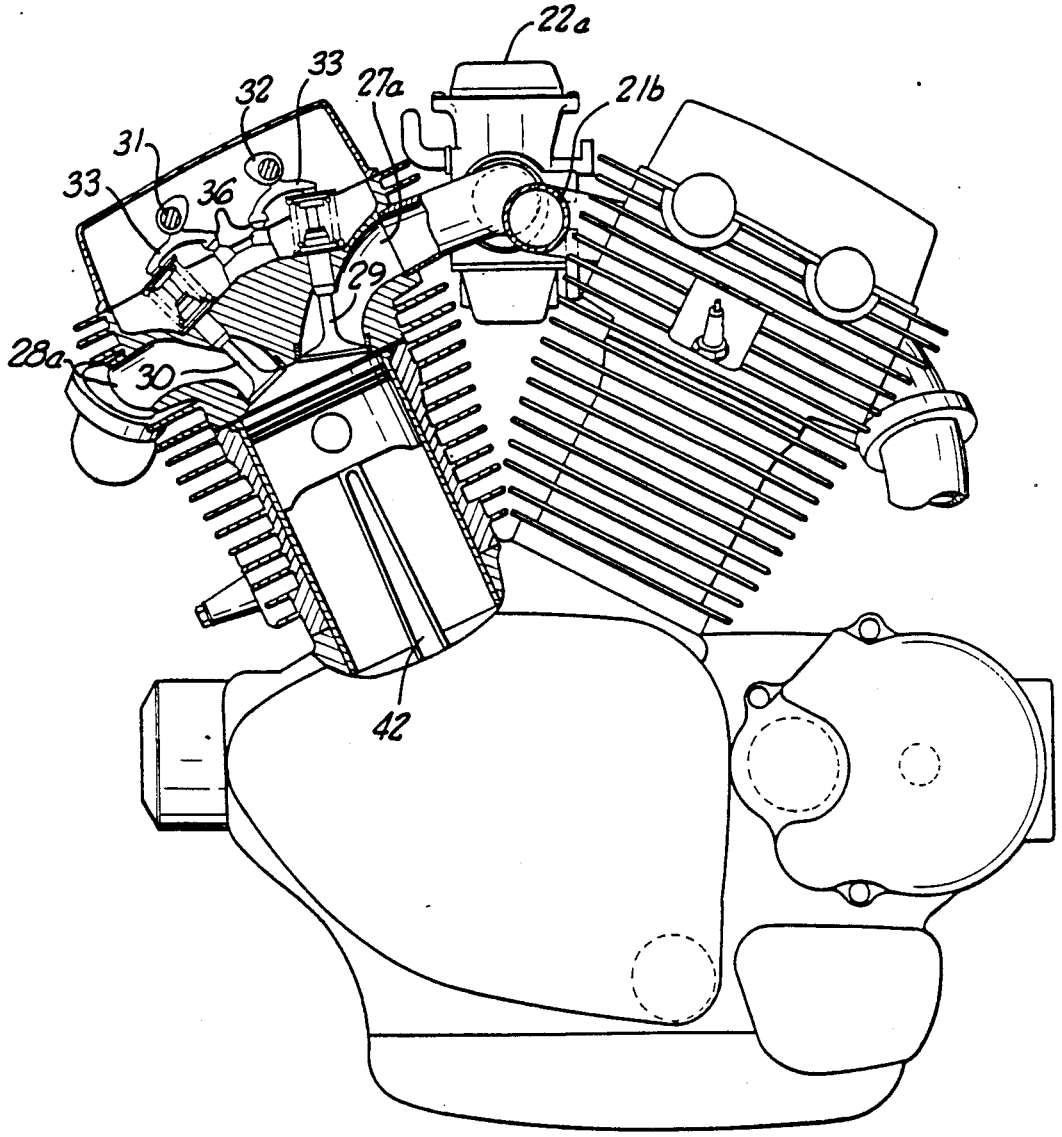
FIG. 5 is a partial cross-sectional view of a 70 degree two-cylinder engine including the present invention taken substantially along line V—V of FIG. 4.
Figure 6:
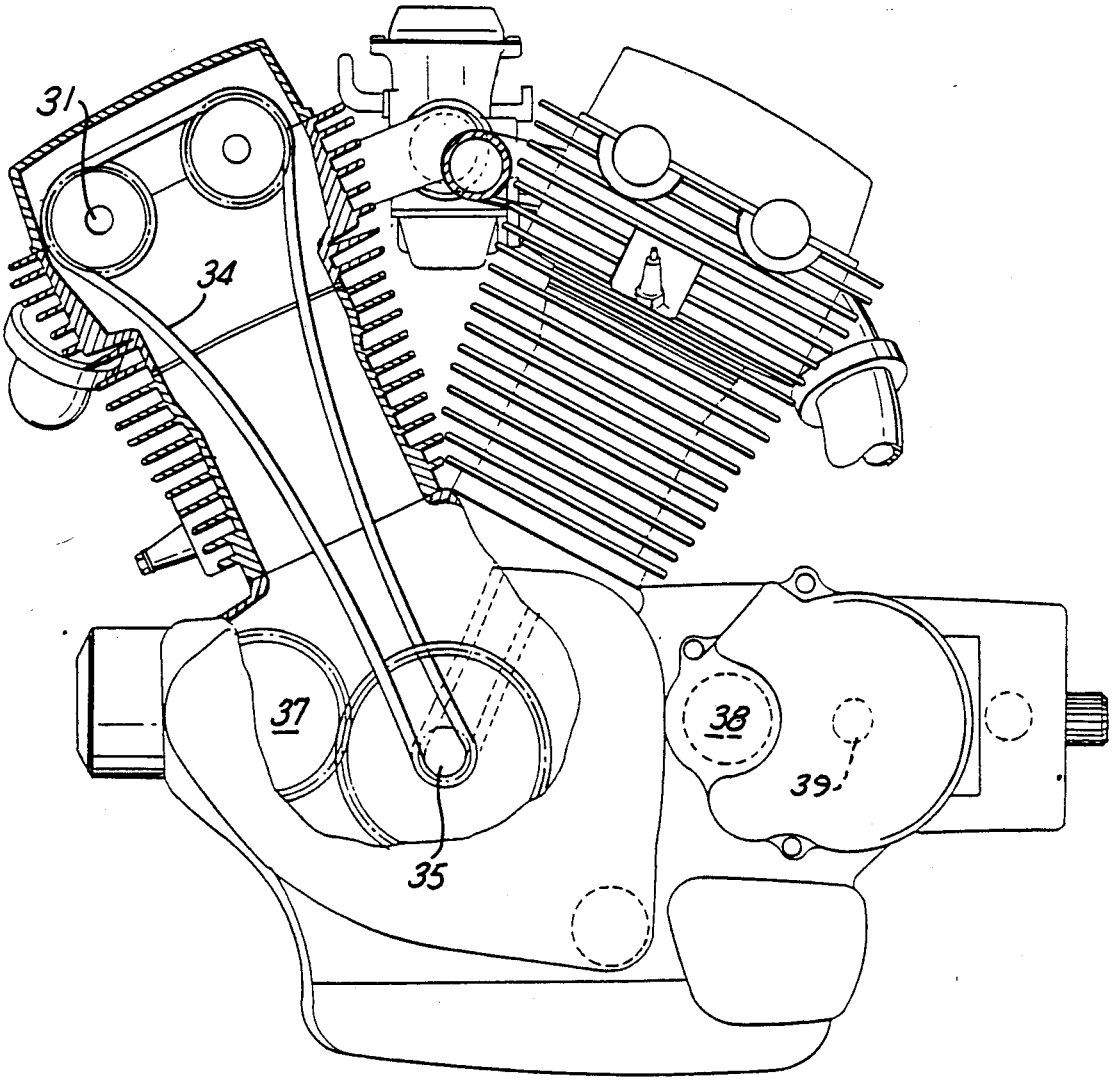
FIG. 6 is a partial cross-sectional side view of a 70 degree two-cylinder engine including the present invention.
Figures 7, 8:
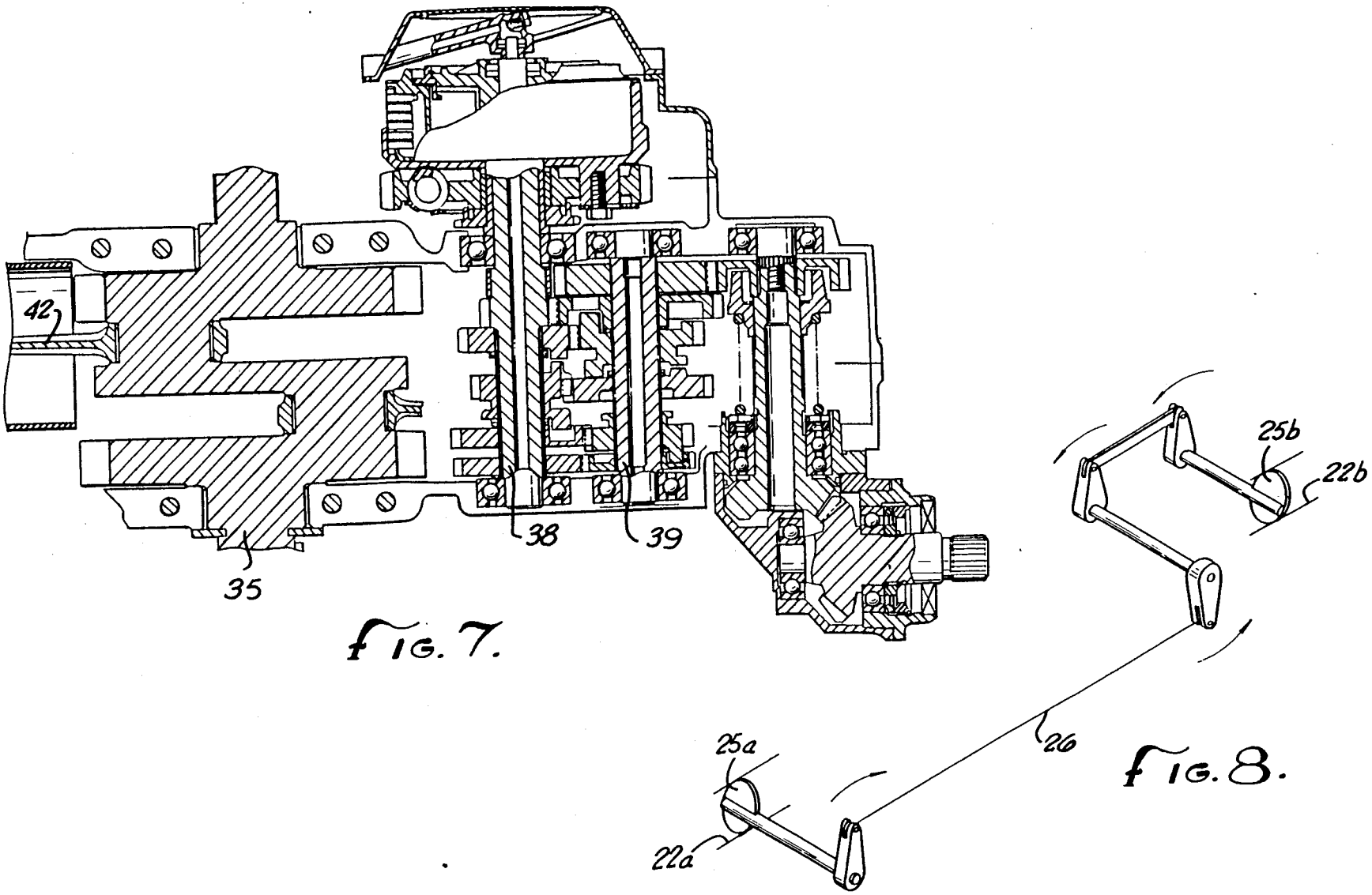
FIG. 7 is a cross-sectional view taken substantially along line 7—7 of FIG. 3.
FIG. 8 is a view of the linking mechanism of the present invention.
Figure 9:
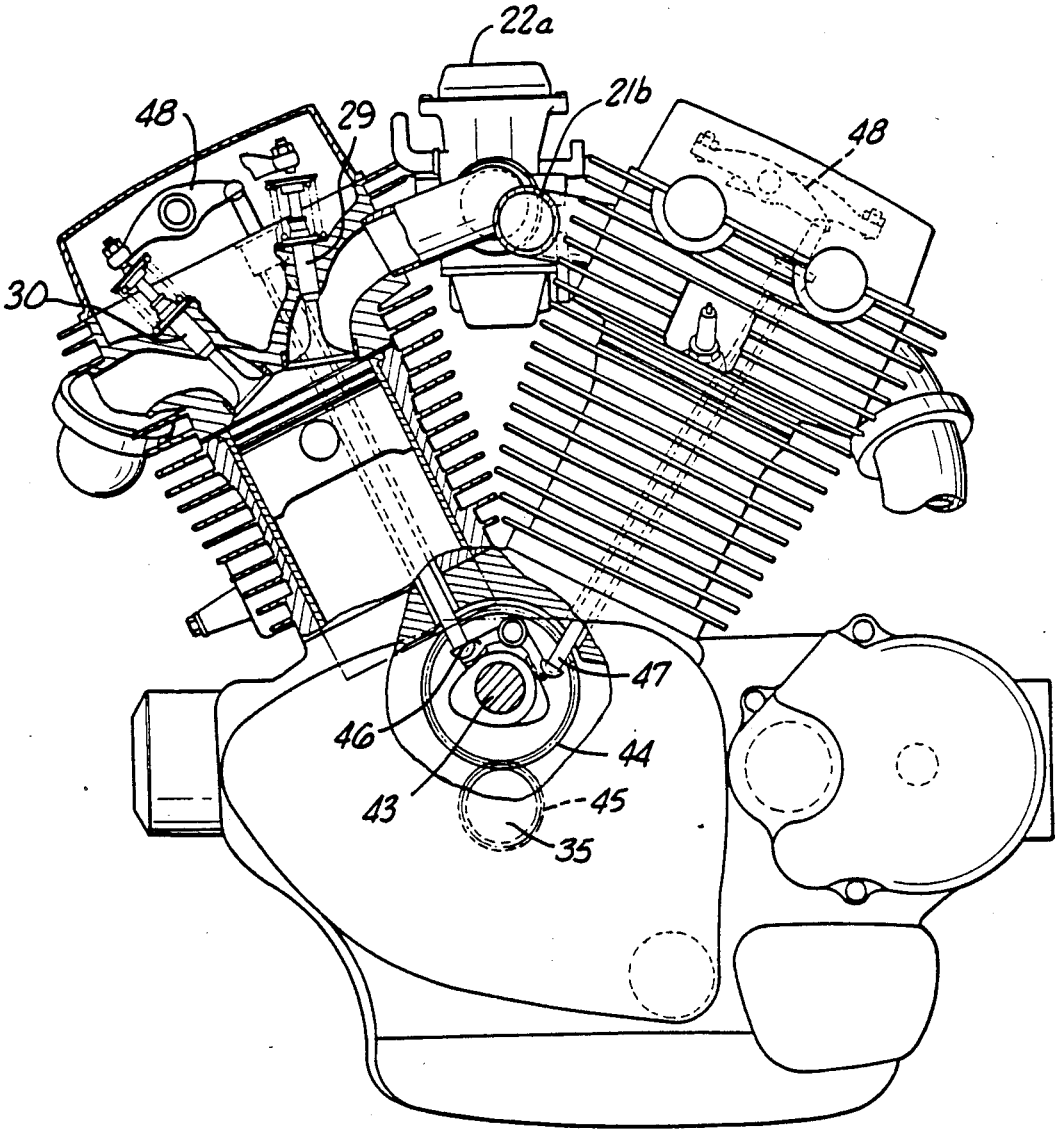
FIG. 9 is a partial side cross-sectional view of a 70 degree two-cylinder engine including the present invention.

Each carburetor 22*a* and *b is connected to an air cleaner 23a* and *b* positioned at each lateral side of the engine (as shown best in FIG. 2 and to the front and back of FIG. 4). An air passage pipe 24 communicates between the air cleaners 23*a* and *b* to equalize any pressure differential therebetween. As best illustrated in FIG. 8, the throttle valve 25*a* and *b* of the carburetors 22*a* and *b*, respectively, are synchronized in movement through a link mechanism 26 in order to provide consistent movement therebetween.

Flow into or out of the cylinder heads 18*a* and *b* of an engine 16 including the present invention is accomplished through intake ports 27 and exhaust ports 28. In a first embodiment of the engine 16 including the present invention, movement of the intake valves 29 and exhaust valves 30 is controlled through overhead camshafts 31 having a cam 32 formed thereon to actuate a rocker arm 33. The camshaft 31 is driven through a camshaft chain 34 which is connected to the crankshaft 35.

An adjuster 36 is provided for each rocker arm. In addition, a shaft balancer 37 is provided to increase the smoothness with which the engine 16 operates and to counteract the forces of the movement of the pistons through the crankshaft 35.

Further, the engine is provided with a main shaft 38 and a countershaft 39 for transmitting power from the engine to the motorcycle. Cooling fins 40 are provided on the exterior of the cylinders 17 and 18 in order to increase the heat dissipation through conduction, convection and radiation therefrom.

A spark plug 41 extends into the cylinders 17*a* and *b* in order to ignite the combustible mixture compressed therein during operation of the engine 16. As illustrated in FIGS. 4 and 7, the cylinders 17*a* and *b* are not aligned longitudinally along the motorcycle (i.e., from left to right in FIG. 4) in view of the offset of the connecting rods 42 on the crankshaft 35.

In a second embodiment of the engine, the upper rocker arms 33 are actuated by push rods 47 driven from a main camshaft 43. The main camshaft 43 is driven by a cam gear 44 off a drive gear 45 which is mounted on the crankshaft 35. A lower rocker arm 46 is positioned about the main camshaft 43 so as to actuate the pushrods 47. The push rods 47 extend to the upper rocker arms 48 which operate the above-described intake valves 29 and exhaust valves 30 in each of the engine cylinder heads 18*a* and *b*.

Figure 10:
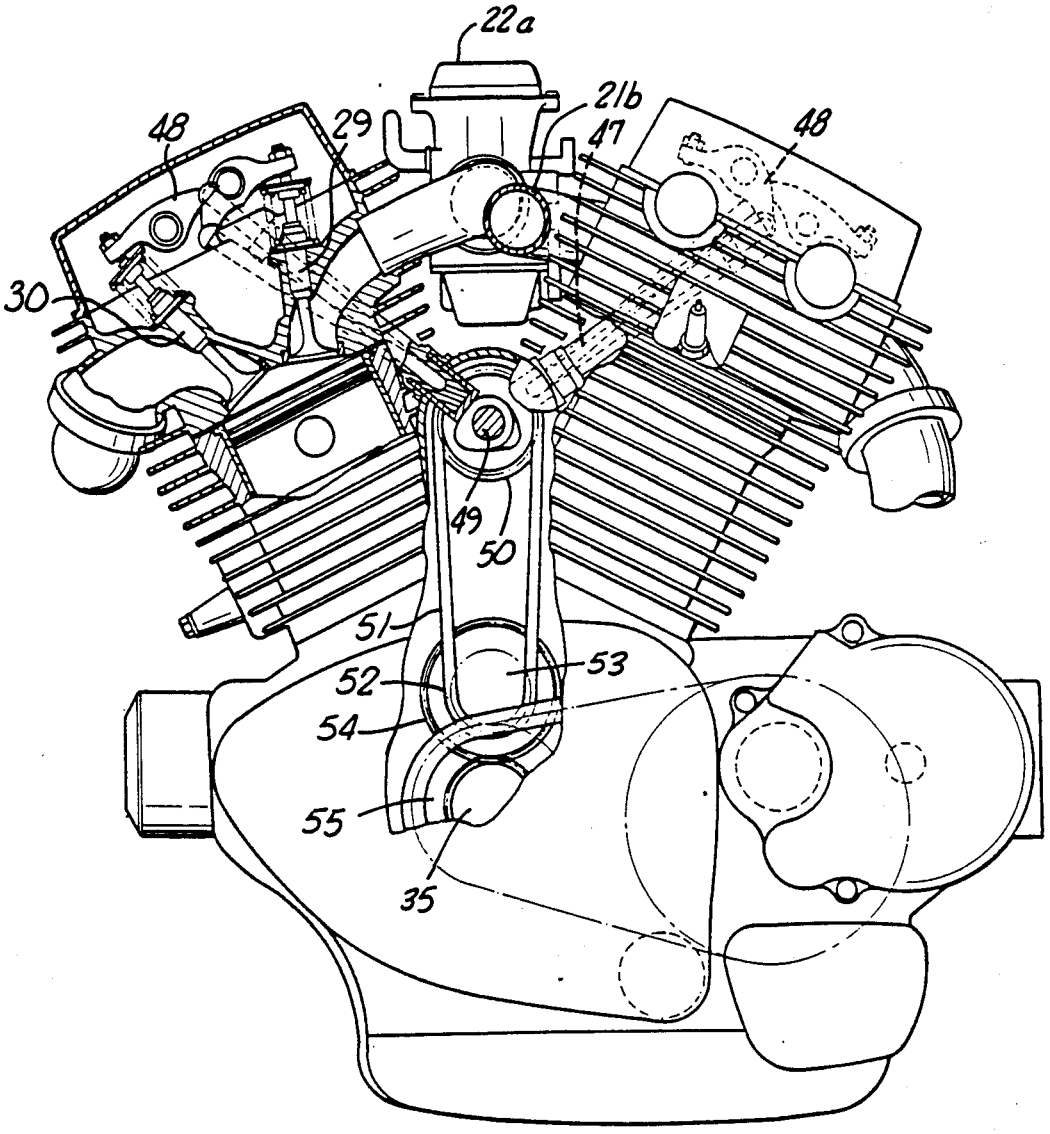
FIG. 10 is a cross-sectional side view of an alternative embodiment of a 70 degree two-cylinder engine including the present invention.

Alternatively, as illustrated in FIG. 10, the engine 16 can have a camshaft 49 which is operated through a drive sprocket 50, a drive chain 51 and a drive sprocket 52 which is mounted on a driveshaft 53. The driveshaft 53 is operated by driven gear 54 through drive gear 55 which is mounted on the crankshaft 35. In such a configuration, the pushrods 56 extend from the vicinity of the camshaft 49 to the upper rocker arms 48 to control the motion of the intake and exhaust valve 29 and 30, respectively.

As illustrated in FIGS. 2–6, the apparatus of the present invention provides air and fuel to the intake passages 19*a* and *b* of the cylinder heads 18*a* and *b* while being contained in the space substantially between the engine cylinder 17*a* and *b* and beneath the engine fuel tank 15. Exhaust from the engine exits through exhaust ports 28*a* and *b* through exhaust pipes 58 where it is subsequently exhausted to the atmosphere through a muffler 60. So constructed, the present invention permits fuel to be fed from the fuel tank 15 to the carburetors 22*a* and *b* through gravity feeding means while maintaining a fuel tank 15 of a sufficient size that auxiliary tanks and concomitant fuel pumps are not needed.

In particular, in one embodiment of the present invention, the carburetors are mounted to the engine cylinders 17*a* and *b* which are connected to the motorcycle body frame 13. The engine air intake passages 19*a* and *b* are arranged so as to extend to the space between the engine cylinders 17*a* and *b*. The engine exhaust passages 28*a* and *b* are arranged so as to extend outward from the angle between the engine cylinders 17*a* and *b* and towards the exhaust pipes 58. The air cleaning means 23*a* and *b* are positioned to each lateral side of the engine 16.

The present invention is described hereinabove for purpose of example only and should not be deemed to limit the scope of the claims appended hereto.

What is claimed is:

1. An engine for a motorcycle, comprising two cylinders arranged in a V-type configuration;

a crankshaft normal to the center plane of the motorcycle;

cylinder heads on said cylinders, each cylinder head having an intake port facing toward the space between said cylinders;

intake pipes coupled with said intake ports, respectively, a first end of each of said intake pipes facing outwardly in substantially the direction of said crankshaft and in mutually opposite directions;

carburetors coupled with said first ends, respectively; and air cleaners coupled with said carburetors, respectively, said air cleaners being outwardly of the space between said cylinders.

2. The engine of claim 1 wherein said intake pipes each include a 90° elbow therein.

3. The engine of claim 2 wherein the cylinders are laterally displaced along the centerline of the crankshaft thereof, said elbows of said intake pipes extending from the cylinder heads in opposite directions between the cylinders.

4. The engine of claim 1 wherein said cylinders are offset from each other to either side of the center plane of the motorcycle, said intake pipes extending in the same direction as the offset of said cylinder associated with the respective said intake pipe.

5. The engine of claim 4 wherein each of said carburetors is located outwardly of the respective said head coupled with each said carburetor.

6. The engine as set forth in claim 1 wherein there is an angle between the engine cylinders and said angle is less than 90 degrees.

* * * * *